US008599018B2

(12) United States Patent
Kellen et al.

(10) Patent No.: US 8,599,018 B2
(45) **Date of Patent: *Dec. 3, 2013**

(54) ALARM SYSTEM HAVING AN INDICATOR LIGHT THAT IS EXTERNAL TO AN ENCLOSED SPACE FOR INDICATING THE TIME ELAPSED SINCE AN INTRUSION INTO THE ENCLOSED SPACE AND METHOD FOR INSTALLING THE ALARM SYSTEM

(76) Inventors: Yael Debra Kellen, Teaneck, NJ (US); Arl Saul Kellen, Teaneck, NJ (US)

( * ) Notice: Subject to any disclaimer, the term of this patent is extended or adjusted under 35 U.S.C. 154(b) by 283 days.

This patent is subject to a terminal disclaimer.

(21) Appl. No.: 12/949,734

(22) Filed: Nov. 18, 2010

(65) Prior Publication Data

US 2012/0126979 A1 May 24, 2012

(51) Int. Cl.
*G08B 13/00* (2006.01)

(52) U.S. Cl.
USPC ..... 340/550; 340/541; 340/545.1; 340/565

(58) Field of Classification Search
USPC ..... 340/541, 524, 545.1, 545.2, 545.3, 340/545.7, 545.9, 565, 506
See application file for complete search history.

(56) References Cited

U.S. PATENT DOCUMENTS

| | | | |
|---|---|---|---|
| 3,601,540 | A | 8/1971 | Bryan |
| 3,745,550 | A | 7/1973 | Anthony et al. |
| 3,774,190 | A | 11/1973 | Kyle, Jr. |
| 3,789,384 | A | 1/1974 | Akers |
| 3,886,352 | A | 5/1975 | Lai |
| 3,911,425 | A | 10/1975 | Muncheryan |
| 4,021,679 | A | 5/1977 | Bolle et al. |
| 4,101,876 | A | 7/1978 | Lurkis et al. |
| 4,225,808 | A | 9/1980 | Saraceni |
| 4,242,670 | A | 12/1980 | Smith |
| 4,284,849 | A | 8/1981 | Anderson et al. |

(Continued)

FOREIGN PATENT DOCUMENTS

| | | |
|---|---|---|
| CA | 2556137 | 8/2006 |
| EP | 0148708 A1 | 1/1984 |

(Continued)

OTHER PUBLICATIONS http://www.residential-landscape-lighting-design.com/store/RLLD2739RAB.htm Downloaded on Mar. 15, 2009 Rab—Motion Sensor—Good Night-Light TUFF Dome.

(Continued)

*Primary Examiner* — Toan N Pham
(74) *Attorney, Agent, or Firm* — Russ Weinzimmer & Associates P.C.

(57) ABSTRACT

An alarm system for indicating the time that has elapsed since intrusion into an enclosed space, as well as a method for installing the alarm system, are disclosed. The alarm system detects an intrusion into the enclosed space, the intrusion thereby causing an indicator light outside the enclosed space to illuminate, thereby indicating time elapsed since intrusion. At least one interior sensor is located within the enclosed space and configured to generate an intrusion time signal in response to movement therein. The indicator light is located within an outer perimeter zone of the enclosed space, and upon receiving an intrusion time signal, the indicator light emits light visible from outside the outer perimeter zone of the enclosed space. The light can indicate time elapsed via a property of the light itself, such as wavelength, intensity and/or focus, and/or via a light display producing readable output of time elapsed, for example.

20 Claims, 11 Drawing Sheets

(56) References Cited

U.S. PATENT DOCUMENTS

| | | | |
|---|---|---|---|
| 4,305,021 | A | 12/1981 | Schreiden |
| 4,342,987 | A | 8/1982 | Rossin |
| 4,484,075 | A | 11/1984 | Kahl, Jr. et al. |
| 4,524,349 | A | 6/1985 | Hyatt |
| 4,531,114 | A | 7/1985 | Topol et al. |
| 4,547,761 | A | 10/1985 | Jones |
| 4,589,081 | A | 5/1986 | Massa et al. |
| 4,618,770 | A | 10/1986 | Maile |
| 4,622,540 | A | 11/1986 | Guscott et al. |
| 4,651,144 | A | 3/1987 | Pagano |
| 4,727,593 | A | 2/1988 | Goldstein |
| 4,730,184 | A | 3/1988 | Bach |
| 4,754,263 | A | 6/1988 | Trimble |
| 4,763,937 | A | 8/1988 | Sittnick, Jr. et al. |
| 4,804,275 | A | 2/1989 | Kang et al. |
| 4,843,283 | A | 6/1989 | Chen |
| 4,862,141 | A | 8/1989 | Jordal |
| 4,873,469 | A | 10/1989 | Young et al. |
| 4,890,093 | A | 12/1989 | Allison et al. |
| 4,902,887 | A | 2/1990 | Everett, Jr. |
| 4,982,176 | A | 1/1991 | Schwarz |
| 5,015,994 | A | 5/1991 | Hoberman et al. |
| 5,126,718 | A | 6/1992 | Doctor |
| 5,128,654 | A | 7/1992 | Griffin et al. |
| 5,155,474 | A | 10/1992 | Park et al. |
| 5,220,250 | A | 6/1993 | Szuba |
| 5,262,758 | A | 11/1993 | Nam et al. |
| 5,371,489 | A | 12/1994 | Carroll et al. |
| 5,463,595 | A | 10/1995 | Roadhall et al. |
| 5,471,194 | A | 11/1995 | Guscott |
| 5,477,205 | A | 12/1995 | Burns |
| 5,483,224 | A | 1/1996 | Rankin et al. |
| 5,488,565 | A | 1/1996 | Kennon et al. |
| 5,555,454 | A | 9/1996 | Dees |
| 5,570,079 | A | 10/1996 | Dockery |
| 5,587,704 | A | 12/1996 | Foster |
| 5,598,066 | A | 1/1997 | Wiesemann et al. |
| 5,691,699 | A | 11/1997 | Vane et al. |
| 5,726,629 | A | 3/1998 | Yu |
| 5,747,937 | A | 5/1998 | Wiesemann et al. |
| 5,760,712 | A | 6/1998 | Sauer |
| 5,831,529 | A | 11/1998 | Pantus |
| 5,854,588 | A | 12/1998 | Dockery |
| 5,867,099 | A | 2/1999 | Keeter |
| 5,890,797 | A | 4/1999 | Bish |
| 5,933,078 | A | 8/1999 | O'Donnell |
| 6,049,274 | A | 4/2000 | Stachurski |
| D424,727 | S | 5/2000 | Greubel |
| 6,067,927 | A | 5/2000 | Johnson et al. |
| 6,118,375 | A | 9/2000 | Duncan |
| 6,320,506 | B1 | 11/2001 | Ferraro |
| 6,323,780 | B1 | 11/2001 | Morris |
| 6,359,564 | B1 | 3/2002 | Thacker |
| 6,384,724 | B1 | 5/2002 | Landais |
| 6,384,728 | B1 | 5/2002 | Kanor et al. |
| 6,392,541 | B1 | 5/2002 | Bucher et al. |
| 6,691,467 | B2 | 2/2004 | Hincher, Sr. |
| 6,710,736 | B2 | 3/2004 | Fullerton et al. |
| 6,741,176 | B2 | 5/2004 | Ferraro |
| 6,747,275 | B2 | 6/2004 | Raper et al. |
| 6,749,319 | B1 | 6/2004 | Muse |
| 6,765,214 | B1 | 7/2004 | Kosslow et al. |
| 6,891,566 | B2 | 5/2005 | Marchese |
| 6,894,609 | B2 | 5/2005 | Menard et al. |
| 6,903,655 | B2 | 6/2005 | Stefanik |
| 6,933,854 | B1 | 8/2005 | Burgess |
| 6,943,687 | B2 | 9/2005 | Lee et al. |
| 6,956,493 | B1 | 10/2005 | Youngblood |
| 6,979,812 | B2 | 12/2005 | Al-Ali |
| 6,998,994 | B2 | 2/2006 | Barnes et al. |
| 7,019,669 | B1 | 3/2006 | Carr |
| 7,034,934 | B2 | 4/2006 | Manning |
| 7,036,951 | B2 | 5/2006 | St-Hilaire |
| 7,155,166 | B2 | 12/2006 | Swan |
| 7,178,952 | B2 | 2/2007 | Bucher et al. |
| 7,239,238 | B2 | 7/2007 | Tester et al. |
| 7,268,689 | B2 | 9/2007 | Sulaver |
| 7,284,880 | B1 | 10/2007 | Steele |
| 7,329,970 | B2 | 2/2008 | Bruwer |
| 7,333,398 | B2 | 2/2008 | Thompson et al. |
| 7,362,663 | B2 | 4/2008 | Kagan |
| 7,492,306 | B2 | 2/2009 | Humphrey et al. |
| 7,498,949 | B2 | 3/2009 | Ito et al. |
| 2002/0014971 | A1 | 2/2002 | Ferraro |
| 2002/0190859 | A1 | 12/2002 | Bucher et al. |
| 2003/0016129 | A1 | 1/2003 | Menard et al. |
| 2003/0122683 | A1 | 7/2003 | Downer |
| 2004/0036603 | A1* | 2/2004 | Bingham ..... 340/541 |
| 2004/0047153 | A1 | 3/2004 | Lee |
| 2004/0049962 | A1 | 3/2004 | Moshirnoroozi |
| 2004/0080615 | A1 | 4/2004 | Klein et al. |
| 2004/0080627 | A1 | 4/2004 | Kroll et al. |
| 2004/0150522 | A1 | 8/2004 | Krause |
| 2004/0178921 | A1 | 9/2004 | Lawrence |
| 2004/0201565 | A1 | 10/2004 | Cunningham et al. |
| 2006/0083305 | A1 | 4/2006 | Dougherty et al. |
| 2006/0197661 | A1 | 9/2006 | Tracy et al. |
| 2006/0230434 | A1 | 10/2006 | Sunagawa |
| 2007/0054618 | A1 | 3/2007 | Lewis et al. |
| 2007/0064541 | A1 | 3/2007 | Kagan |
| 2007/0075854 | A1 | 4/2007 | Tyler |
| 2007/0109763 | A1 | 5/2007 | Wolf et al. |
| 2007/0133356 | A1 | 6/2007 | O'Connor |
| 2007/0195703 | A1 | 8/2007 | Boyajian et al. |
| 2007/0222577 | A1 | 9/2007 | Wilson et al. |
| 2007/0236360 | A1 | 10/2007 | Fitzgibbon |
| 2007/0263968 | A1 | 11/2007 | Lath |
| 2007/0268687 | A1 | 11/2007 | Scannell, Jr. |
| 2007/0300091 | A1 | 12/2007 | Lee |
| 2008/0151056 | A1 | 6/2008 | Ahamefula |
| 2008/0232199 | A1 | 9/2008 | Shafton |
| 2008/0252730 | A1* | 10/2008 | Hong ..... 348/155 |
| 2008/0291036 | A1 | 11/2008 | Richmond |
| 2009/0009326 | A1 | 1/2009 | Veiga, III |
| 2009/0033460 | A1 | 2/2009 | Mack et al. |
| 2009/0070076 | A1 | 3/2009 | Braunstein et al. |
| 2009/0140858 | A1 | 6/2009 | Gore et al. |

FOREIGN PATENT DOCUMENTS

| | | | |
|---|---|---|---|
| EP | 454313 | A3 | 4/1991 |
| EP | 687591 | A2 | 6/1995 |
| GB | 2244129 | A | 4/1991 |
| GB | 2380338 | A | 9/2001 |
| JP | 56103633 | A2 | 1/1980 |
| JP | 01299973 | A3 | 5/1988 |
| JP | 02095526 | A2 | 9/1988 |
| JP | 01286563 | A | 11/1989 |
| JP | 2000215356 | A2 | 1/1990 |
| JP | 04287756 | A2 | 3/1991 |
| JP | 04315687 | A2 | 4/1991 |
| JP | 06162364 | A2 | 11/1992 |
| JP | 06342082 | A2 | 5/1993 |
| JP | 06287537 | A2 | 7/1993 |
| JP | 07093686 | A2 | 9/1993 |
| JP | 08015428 | A2 | 6/1994 |
| JP | 08042209 | A2 | 7/1994 |
| JP | 10176312 | A2 | 12/1996 |
| JP | 10222788 | A2 | 2/1997 |
| JP | 10253757 | A2 | 3/1997 |
| JP | 11066472 | A2 | 8/1997 |
| JP | 11086159 | A2 | 9/1997 |
| JP | 11086168 | A2 | 9/1997 |
| JP | 11242784 | A2 | 2/1998 |
| JP | 11287875 | A2 | 3/1998 |
| JP | 11296767 | A2 | 4/1998 |
| JP | 2000085535 | A2 | 9/1998 |
| JP | 2000286978 | A | 3/1999 |
| JP | 2001032588 | A2 | 7/1999 |
| JP | 2001148845 | A2 | 11/1999 |
| JP | 2003198741 | A2 | 12/2001 |
| JP | 2002083383 | A | 3/2002 |
| JP | 2004192466 | A2 | 12/2002 |
| JP | 2004206290 | A2 | 12/2002 |

(56) References Cited

FOREIGN PATENT DOCUMENTS

| | | | |
|---|---|---|---|
| JP | 2004220101 | A2 | 1/2003 |
| JP | 2005011223 | A2 | 6/2003 |
| JP | 2005165993 | A2 | 11/2003 |
| JP | 2006011895 | A2 | 6/2004 |
| JP | 2005126996 | A | 5/2005 |
| JP | 2007054501 | A2 | 8/2005 |
| JP | 2007071658 | A2 | 9/2005 |
| JP | 2008076220 | A | 9/2006 |
| JP | 2006286276 | A | 10/2006 |
| JP | 2008158854 | A2 | 12/2006 |
| JP | 2007172438 | A | 5/2007 |
| JP | 2008040863 | A | 2/2008 |
| KR | 0385019 | B1 | 1/1999 |
| KR | 3047240 | A | 12/2001 |
| NZ | 0331250 | A | 8/1999 |
| RU | 2309861 | C1 | 11/2006 |
| WO | 9216916 | A1 | 3/1992 |
| WO | 9422118 | A1 | 9/1994 |
| WO | 0043968 | A1 | 1/2000 |
| WO | 0075900 | A1 | 6/2000 |
| WO | 0182004 | A1 | 4/2001 |
| WO | 0189369 | A3 | 5/2001 |
| WO | 0106473 | A3 | 11/2001 |
| WO | 2004044619 | A2 | 5/2004 |
| WO | 2004079684 | A1 | 9/2004 |
| WO | 2005022477 | A1 | 3/2005 |
| WO | 2006097920 | A3 | 9/2006 |
| WO | 2007016741 | A1 | 2/2007 |
| WO | 2007096583 | A1 | 2/2007 |
| WO | 2007034473 | A3 | 3/2007 |
| WO | 2007116452 | | 10/2007 |
| WO | 2007138308 | A2 | 12/2007 |
| WO | 2008054459 | A3 | 5/2008 |
| WO | 2008134927 | A1 | 11/2008 |

OTHER PUBLICATIONS http://www.x10.com/automation/index.html#motion_sensors Downloaded on Mar. 15, 2009.

http://www.x10.com/products/x10_ms16a.htm Downloaded on Mar. 15, 2009.

http://www.x10.com/activehomepro/plugins/plugin-myhouse.html Downloaded on Mar. 15, 2009.

http://www.crutchfield.com/S-bOzrkHXfCvd/p_514CG35015/Crime-Guard-350i5.html?tab=detailed_info Downloaded on Mar. 31, 2009.

http://elektron.uw.hu/elektro/PIC/riaszto/riaszto.pdf. Downloaded on Mar. 31, 2009.

http://archives.sensorsmag.com/articles/0902/32/main.shtml Downloaded on Mar. 31, 2009 An Optical Timing System.

http://www.smarthome.com/73951/Wireless-Glassbreak-Sensor-MCT-501-315MHz-/p.aspx Downloaded Apr. 3, 2009 Overview.

http://www.arlec.com.au/instruct/DA200.pdf. Downloaded on Apr. 3, 2009.

http://www.maxximastyle.com/Merchant2/merchant.mvc?Screen=PROD&Product_Code=SDL-60&Category_Code=MN Downloaded on Apr. 3, 2009.

http://www.faqs.org/rulings/rulings1990HQ0085074.html Downloaded on Apr. 3, 2009.

US 4,992,701, 02/1991, Sacchetti (withdrawn)

* cited by examiner

ALARM SYSTEM HAVING AN INDICATOR LIGHT THAT IS EXTERNAL TO AN ENCLOSED SPACE FOR INDICATING THE TIME ELAPSED SINCE AN INTRUSION INTO THE ENCLOSED SPACE AND METHOD FOR INSTALLING THE ALARM SYSTEM

CROSS-REFERENCE TO RELATED APPLICATIONS

This application is a Continuation-in-Part of application Ser. No. 12/949,730, entitled "Alarm System Having An Indicator Light That Is External To An Enclosed Space For Indicating An Intrusion Into The Enclosed Space And A Method For Installing The Alarm System," and filed on Nov. 18, 2010, incorporated herein by reference in its entirety.

This application is also related to application Ser. No. 12/949,738, entitled "Alarm System Having An Indicator Light That Is External To An Enclosed Space For Indicating The Specific Location Of An Intrusion Into The Enclosed Space And A Method For Installing The Alarm System," and filed on Nov. 18, 2010, which is also a Continuation-in-Part of application Ser. No. 12/949,730, entitled "Alarm System Having An Indicator Light That Is External To An Enclosed Space For Indicating An Intrusion Into The Enclosed Space And A Method For Installing The Alarm System," and filed on Nov. 18, 2010.

FIELD

The invention relates generally to systems and methods for intruder detection, and more particularly to notification of an intruder detection event.

BACKGROUND

Security systems for protecting buildings and other structures from intrusion are well known in the art. Such security systems generally include one or more alarms to notify others of an attempted or actual intrusion. These alarms can include audible signals and/or lights to indicate when a breach or attempted breach of a structure, such as the prying open of a door or window, has occurred. Such security systems can help to protect building owners and/or inhabitants from would-be intruders and actual intruders, such as burglars.

While many of these systems activate alarms to notify others of attempted or successful intrusions, these systems typically do not provide information as to whether there was merely an attempted intrusion, or an actual intrusion. Other systems may activate an alarm only to indicate an actual intrusion, but the alarm may deactivate or may be deactivated before the user of the system arrives upon the scene of the intrusion.

Furthermore, without sound, the alarms of known alarm systems are not easily noticeable from outside an enclosed space that was intruded upon. For example, the alarms of some systems are small, inconspicuous, and silent panels of information about an intrusion. Still other alarms that do provide sound do not clearly identify and locate the enclosed space that was intruded upon. Even though a loud alarm may be activated upon intrusion, the general location of the enclosed space being intruded upon may be unclear or ambiguous to observers outside the enclosed space.

SUMMARY

An alarm system with an indicator light that is external to an enclosed space for indicating an intrusion into an enclosed space and the time elapsed since an intrusion into the enclosed space, and a method of installing such a system, are claimed. The system can be purchased and installed inexpensively and easily, and it can provide a signal that does not terminate until terminated by the user of the alarm system, and is easily recognizable to the user of the system upon the user's arrival upon or near the enclosed space. The signal indicates time elapsed since an intrusion into the enclosed space, thereby warning others of the potential of an intruder lurking and perhaps lying in wait, within the enclosed space.

Upon detecting an intrusion into the enclosed space, the alarm system employs an indicator light that is located within an outer perimeter zone that surrounds the enclosed space. Upon activation, the indicator light emits light that extends beyond the outer perimeter zone of the enclosed space as an intrusion alert, thereby reducing the need of a user to enter the outer perimeter zone of the enclosed space to determine the specific location of the intrusion. The alert is conspicuous and easily recognizable to anyone who approaches the outer perimeter zone of the enclosed space being intruded upon. An indicator light alarm is typically also easier for people to trace to its source than is a sound alarm, particularly if the enclosed space is situated close to other enclosed spaces with which it could be confused. The enclosed space can be a building, or a particular section of a building or room of a building, for example.

The alarm system provides alerts regarding the elapsed time since intrusion into an enclosed space and/or structure, in addition to alerting a user of the fact of an intrusion. The alert provides elapsed time information regarding only successful intrusions into an enclosed space, as opposed to mere attempted intrusions.

Typically, the more time that has elapsed since an intrusion, the less likely the intruder is still present within the enclosed space. An alert indicating elapsed time since an intrusion therefore can be helpful in a variety of ways, such as enhancing the decision-making process for the user or others investigating the intrusion, regarding how they would respond to the alert.

For example, information regarding the elapsed time since an intrusion can affect someone's decision regarding whether to enter the enclosed space promptly, or await further help, such as the arrival of the police.

The present alarm system having an indicator light that is external to an enclosed space for indicating the time elapsed since an intrusion into an enclosed space, can benefit from use with the invention disclosed in patent application Ser. No. 12/949,738, entitled "Alarm System Having An Indicator Light That Is External To An Enclosed Space For Indicating The Specific Location Of An Intrusion Into The Enclosed Space And A Method For Installing The Alarm System," and filed on Nov. 18, 2010.

In one embodiment, the invention is an alarm system for providing an indication of time elapsed since an intrusion into an enclosed space, the enclosed space being surrounded by an outer perimeter zone, the indication enabling an observer situated outside the outer perimeter zone to learn at least approximately how much time has elapsed since the intrusion, the alarm system comprising: one or more interior sensor being located within an enclosed space, the one or more sensor configured to generate an intrusion time signal in response to an intrusion into the enclosed space; an indicator light responsive to the intrusion time signal, the indicator light being located outside the enclosed space and within an outer perimeter zone of the enclosed space, the indicator light being configured to emit light upon receiving the intrusion time signal, the emitted light being visible from outside the outer perimeter zone of the enclosed space, thereby rendering the enclosed space readily identified as having been intruded upon by an observer situated outside a perimeter zone of the enclosed space; and a light changing system responsive to the intrusion time signal, and in communication with the indicator light, the light changing system being configured to change the emitted light over time so as to indicate at least approximately how much time has elapsed since the intrusion.

In another embodiment, the invention is a method of installing an alarm system for providing an indication of time elapsed since an intrusion into an enclosed space, the enclosed space being surrounded by an outer perimeter zone, the indication enabling an observer situated outside the outer perimeter zone to learn at least approximately how much time has elapsed since the intrusion, the alarm system comprising: mounting at least one interior sensor located within an enclosed space, the at least one sensor being configured to generate an intrusion time signal in response to an intrusion into the enclosed space; mounting an indicator light responsive to the intrusion time signal, the indicator light being located outside the enclosed space and within an outer perimeter zone of the enclosed space, the indicator light being configured to emit light upon receiving the intrusion time signal, the emitted light being visible from outside the outer perimeter zone of the enclosed space, thereby rendering the enclosed space readily identified as having been intruded upon by an observer situated outside a perimeter zone of the enclosed space; and installing a light changing system responsive to the intrusion time signal, and in communication with the indicator light, the light changing system being configured to change the emitted light over time so as to indicate at least approximately how much time has elapsed since the intrusion.

In other embodiments, the emitted light is changed by changing: wavelength of the emitted light; intensity of the emitted light; focus of the emitted light, wherein the emitted light is a light beam; frequency of blinking of the emitted light, wherein the emitted light is a blinking light; and/or alphanumeric pattern of the emitted light, wherein the emitted light is produced by an alphanumeric display.

In other embodiments, the indicator light is a light display that is capable of producing a readable output of the time elapsed since the intrusion, and the light changing system is configured to change the readable output as time elapses. In other embodiments, the indicator light is a focused light beam, a beacon light, a blinking light, and/or a rotating light.

In other embodiments, the one or more interior sensor is capable of detecting intrusion into the structure in proximity to a peripheral window of the enclosed space, a peripheral door of the enclosed space, a chimney of the enclosed space, and/or a general internal area of the enclosed space.

In some embodiments, the intrusion time signal is sent directly from the one or more interior sensor to the indicator light, thereby initiating activation of the indicator light. In other embodiments, the light changing system is configured to receive the intrusion time signal from the one or more intrusion detector, and send an activation signal to the indicator light, thereby initiating activation of the indicator light. In other embodiments, the intrusion time signal is sent from the one or more interior sensor to the indicator light via electrical wiring or wireless signaling.

In other embodiments, the intrusion time signal is also received on a mobile device. In other embodiments the system can be activated by a keypad installed near an entrance of the enclosed space, a keypad installed within the outer perimeter zone of the enclosed space, a manual key configured to fit a manual lock, a remote control device dedicated to activation of the system, and/or a personal mobile communication device.

BRIEF DESCRIPTION OF THE DRAWINGS

The invention will be more fully understood by reference to the detailed description, in conjunction with the following figures, wherein.

DETAILED DESCRIPTION

Figure 1A:
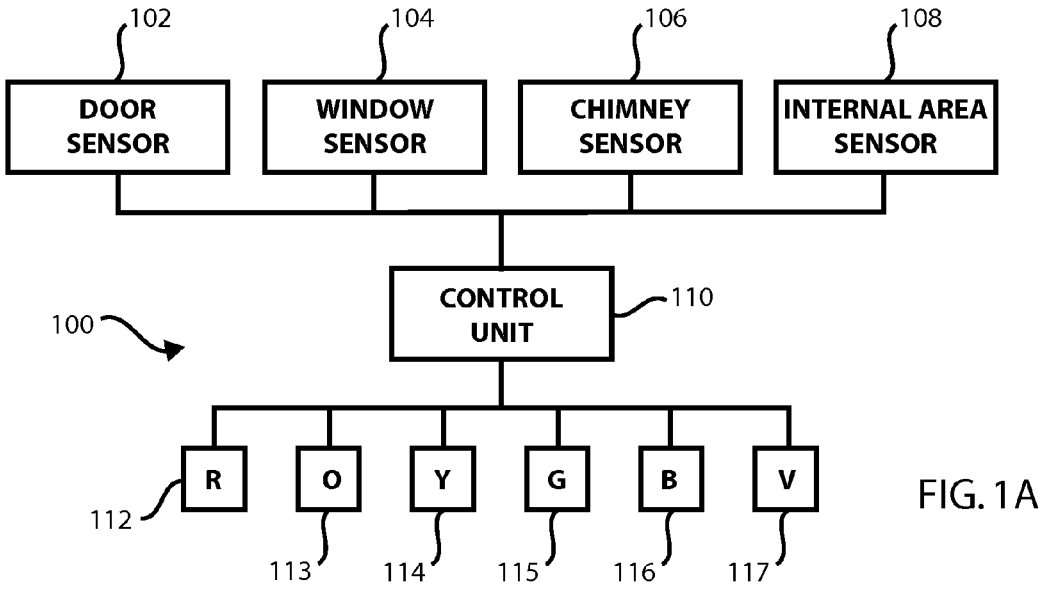
FIG. 1A is a block diagram showing the main elements of an embodiment of the alarm system.

FIG. 1A is a block diagram showing the main elements of an embodiment of the alarm system. In the embodiment represented by the diagram of the system elements 100, several interior sensors are placed within an interior space of a building, which in this case is a house.

The enclosed space to be equipped with the alarm system can be any building or enclosed portion of a building (such as a section or room of the building) for which a user of the system wishes to receive notice of the intrusion by another into the enclosed space. Such enclosed space can include rooms, sections, levels, or entire internal areas of buildings such as houses, apartments, schools, dorm rooms, office buildings, factories, or any other buildings apparent to one of ordinary skill in the art of intrusion alert systems.

In the embodiment shown, the sensors are placed in such a manner so as to detect intrusion of the building. In alternative embodiments, sensors can be strategically placed so as to detect intrusion of a certain particular enclosed space of the building, such as a particular room or group of adjacent rooms, or an entire floor level of the building, for example. The exemplary sensors shown include a door sensor 102, a window sensor 104, a chimney sensor 106, and an internal area sensor 108.

Sensors can be placed in proximity to access points to the building or an enclosed portion of the building, so as to detect intrusion of the enclosed space through the access point. Such access points which the sensor may be placed near can include a door 102, window 104 or chimney 106, for example. Another sensor can be placed within a general internal area of an enclosed space 108, so as to detect movement inside the enclosed space, or so as to employ any other means of detecting intrusion apparent to one of ordinary skill in the art of intrusion detection.

The sensors can be any kind of sensor configured to detect intrusion, such as a heat sensor or infrared sensor, for example. One skilled in the art will appreciate and readily acknowledge other possible sensors which can be used. If an intrusion occurs, a sensor will detect the intrusion and send an intrusion time signal to a control unit 110. The control unit 110 will send the intrusion time signal to an indicator light located outside the enclosed space and in an outer perimeter zone of the enclosed space. The control unit 110 can serve as a light changing system, configured to change a property of the light output over time so as to indicate an amount of time elapsed since intrusion.

The indicator light will emit light so as to indicate that an intrusion has occurred, and indicate the time that has elapsed since intrusion has occurred. Other sensors positioned and configured to detect movement within the enclosed space for which intrusion is to be detected will be readily apparent to one ordinarily skilled in the art of intrusion detection.

A light changing system changes a property of the light emitted by the indicator light over time, so as to indicate an amount of time elapsed since the intrusion. In the embodiment shown, the indicator light can change the color of the light over time, so as to roughly indicate the amount of time that has elapsed. For example, immediately upon detecting an intrusion, the indicator light emits red light 112. After a half hour, for example, the indicator light emits orange light 113. After another half hour, the indicator light emits yellow light 114, then green light 115 after another half hour, blue light 116 after yet another half hour, and finally, violet light 117 thereafter.

Figure 1B:
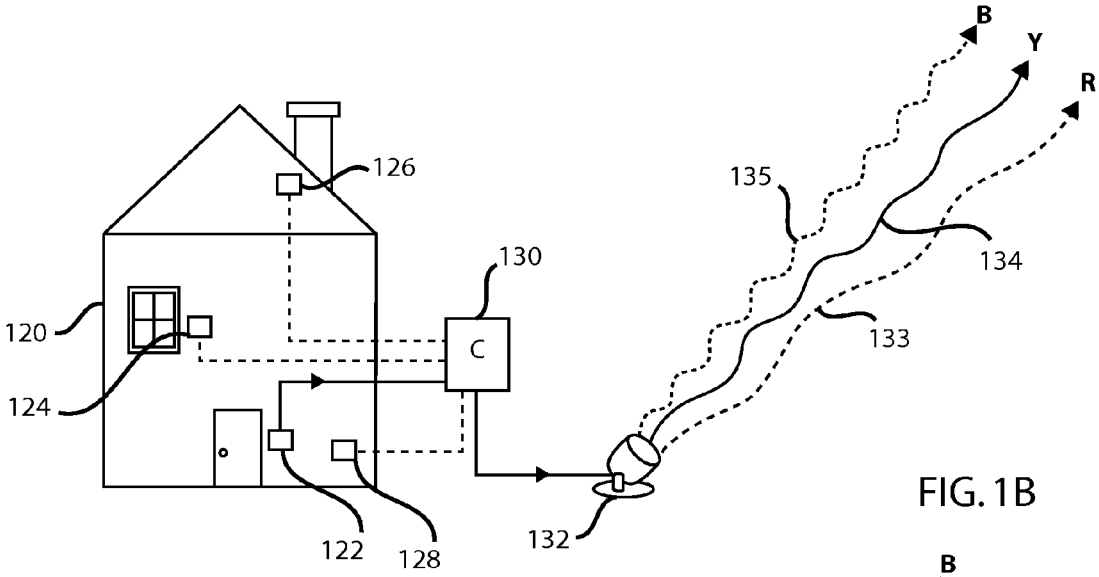
FIG. 1B is an elements diagram showing the interaction between the main elements of an embodiment of the alarm system, wherein the main elements are hard wired together.

FIG. 1B is an elements diagram showing the interaction between the main elements of an embodiment of the alarm system, wherein the main elements are hard wired together with electrical wiring. A house 120 equipped with an embodiment of the alarm system is shown, containing a door sensor 122, window sensor 124, chimney sensor 126, and internal area sensor 128.

As depicted in this diagram, the sensors are hard wired to a common control unit 130, which in turn is in hard wire communication with an indicator light 132. In the embodiment shown, the control unit 130 is located outside the structure of the house 130. Upon receiving an intrusion time signal from any of the sensors, the control unit 130 can propagate the signal to the indicator light 132 located in the outer perimeter zone of the enclosed space, which emits light that is visible beyond the outer perimeter zone of the enclosed space, thereby alerting others to an intrusion and elapsed time since intrusion. In this embodiment, the indicator light 132 is located outside the house but within a curtilage of the house 120, and produces light that is visible beyond the curtilage.

In the embodiment shown, the indicator light 132 changes the color of the light over time, so as to roughly indicate the amount of time that has elapsed. In this example, immediately upon detecting an intrusion, the indicator light emits red light 133. After a certain amount of time, the color of the light will change to yellow light 134. In the embodiment shown, the light is currently yellow 134. After another certain amount of time, the color of the light will change again, to blue light 135.

Figure 1C:
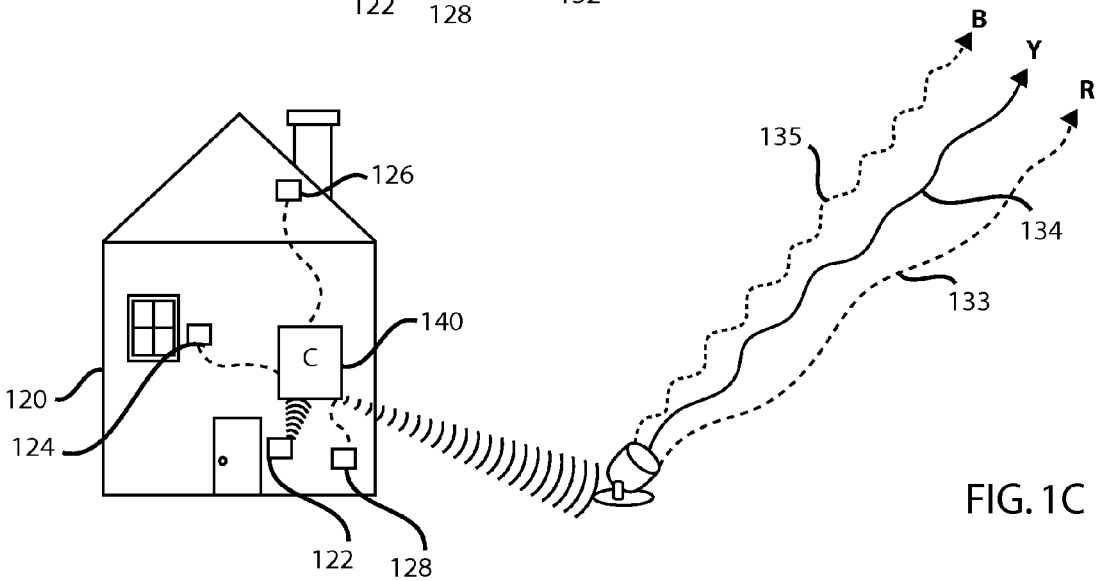
FIG. 1C is an elements diagram showing the interaction between the main elements of an alternative embodiment of the alarm system wherein the main elements are connected together via wireless communication.

FIG. 1C is an elements diagram showing the interaction between the main elements of an alternative embodiment of the alarm system wherein the main elements are connected together via wireless signaling. A house 120 equipped with an embodiment of the alarm system is shown, containing a door sensor 122, window sensor 124, chimney sensor 126, and internal area sensor 128.

As depicted in this diagram, the sensors are linked via wireless connection to a common control unit 140, which in turn is in wireless communication with an indicator light 132. In the embodiment shown, the control unit 140 is located inside the structure of the house 120. Upon receiving an intrusion time signal from any of the sensors, the control unit 140 can propagate the signal to the indicator light 132 located in the outer perimeter zone of the enclosed space, which emits light that is visible beyond the outer perimeter zone of the enclosed space thereby alerting others to an intrusion. In this embodiment, the indicator light 132 is located outside the house but within a curtilage of the house 120, and produces light that is visible beyond the curtilage.

In the embodiment shown, the indicator light 132 changes the color of the light over time, so as to roughly indicate the amount of time that has elapsed. In this example, immediately upon detecting an intrusion, the indicator light emits red light 133. After a certain amount of time, the color of the light will change to yellow light 134. In the embodiment shown, the light is currently yellow 134. After another certain amount of time, the color of the light will change again, to blue light 135.

Figure 2A:
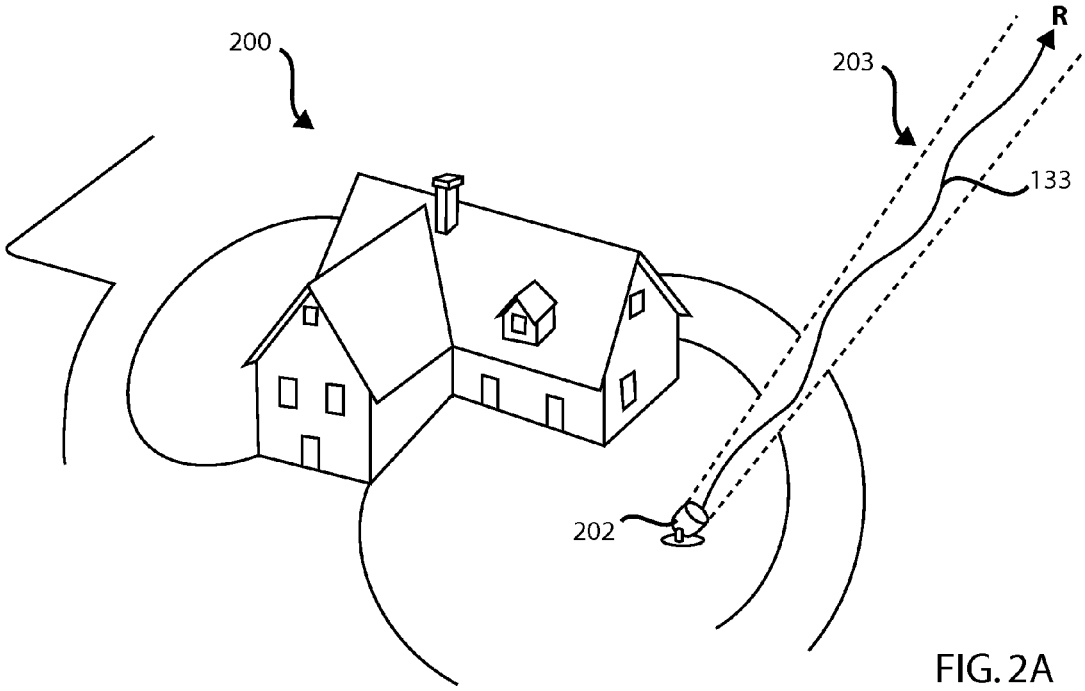
FIG. 2A is an aerial view of a house equipped with an installed version of an embodiment of the alarm system, showing the light output indicating a small amount of time elapsed since a recent intrusion.

FIG. 2A is an aerial view of a house equipped with an installed version of an embodiment of the alarm system, showing the light output indicating a small amount of time elapsed since a recent intrusion. In this embodiment, the house 200 is equipped with an indicator light 202 that emits a continuous light beam 203. In alternative embodiments, the light can be a blinking light rather than a light of continuous output, for example. In still other embodiments, the light can be a beacon light rather than a light beam.

In the embodiment shown in this figure, the light beam 203 is comprised of light of long wavelength 133, which in this example is red light. In this embodiment, the frequency is a property of the light which indicates time elapsed since intrusion into the house 200. In the embodiment shown, a red beam of light 203 indicates a recent intrusion into the house 200.

Figure 2B:
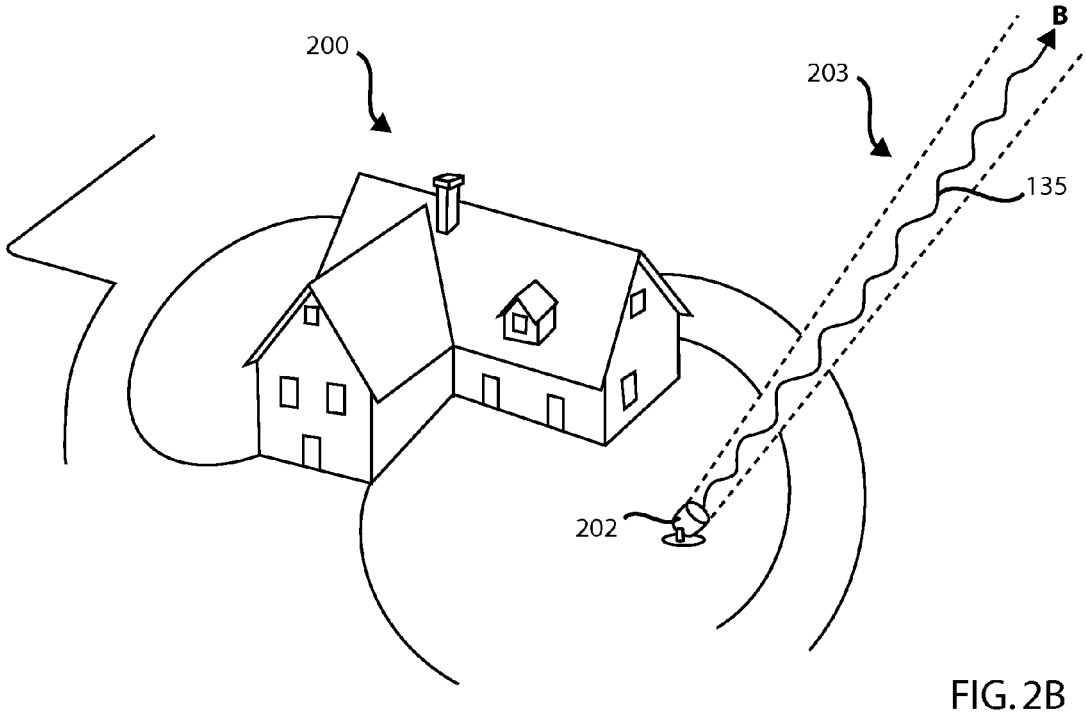
FIG. 2B is an aerial view of a house equipped with an installed version of the embodiment shown in FIG. 2A, showing the light output indicating a larger amount of time elapsed since the intrusion.

FIG. 2B is an aerial view of a house equipped with an installed version of the embodiment shown in FIG. 2A, showing the light output indicating a larger amount of time elapsed since the intrusion. In this figure, the light beam 203 is now comprised of light of shorter wavelength 135 than it was earlier, as shown in FIG. 2A. In this example, the light 203 is now of blue color. This light of shorter wavelength indicates that intrusion into the house 200 has occurred, but it did not occur immediately.

Figure 3A:
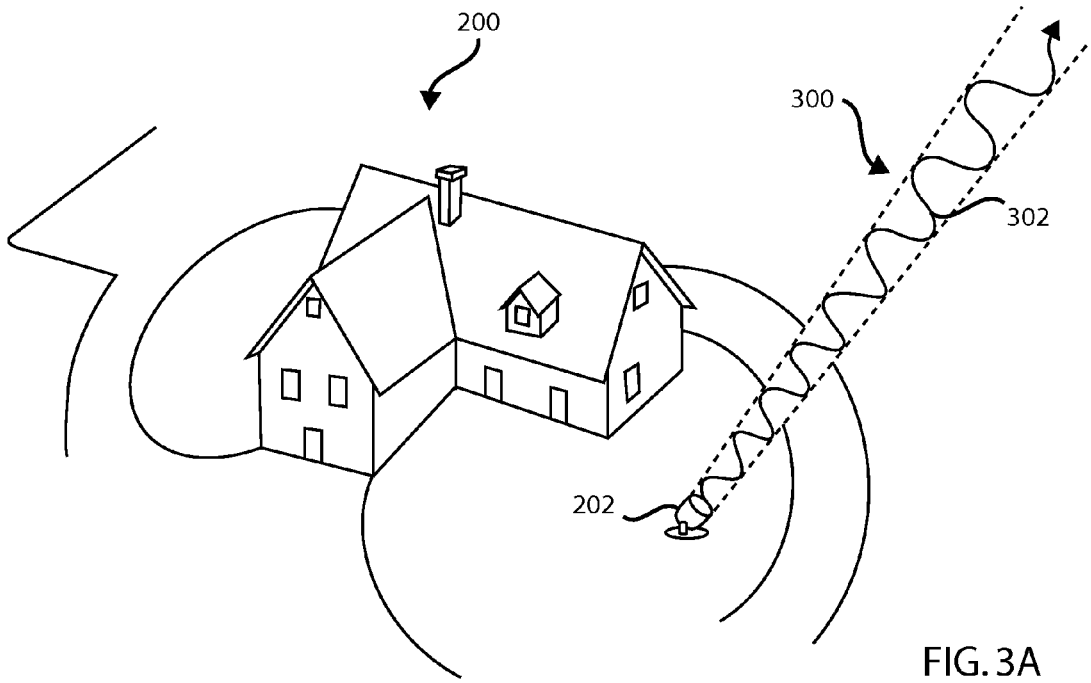
FIG. 3A is an aerial view of a house equipped with an installed version of an alternate embodiment of the alarm system, showing the light output indicating a small amount of time elapsed since a recent intrusion.

FIG. 3A is an aerial view of a house equipped with an installed version of a different embodiment of the alarm system, showing the light output indicating a small amount of time elapsed since a recent intrusion. In this embodiment, the house 200 is equipped with an indicator light 202 that emits a continuous light beam 300. In alternative embodiments, the light can be a blinking light rather than a light of continuous output, for example. In still other embodiments, the light can be a beacon light rather than a light beam.

In the embodiment shown in this figure, the light beam 300 is focused and high intensity light 302. In this embodiment, the intensity and focus of the light is a property of the light which indicates time elapsed since intrusion into the house 200. In the embodiment shown, a high intensity and highly focused beam of light 302 indicates a recent intrusion into the house 200.

Figure 3B:
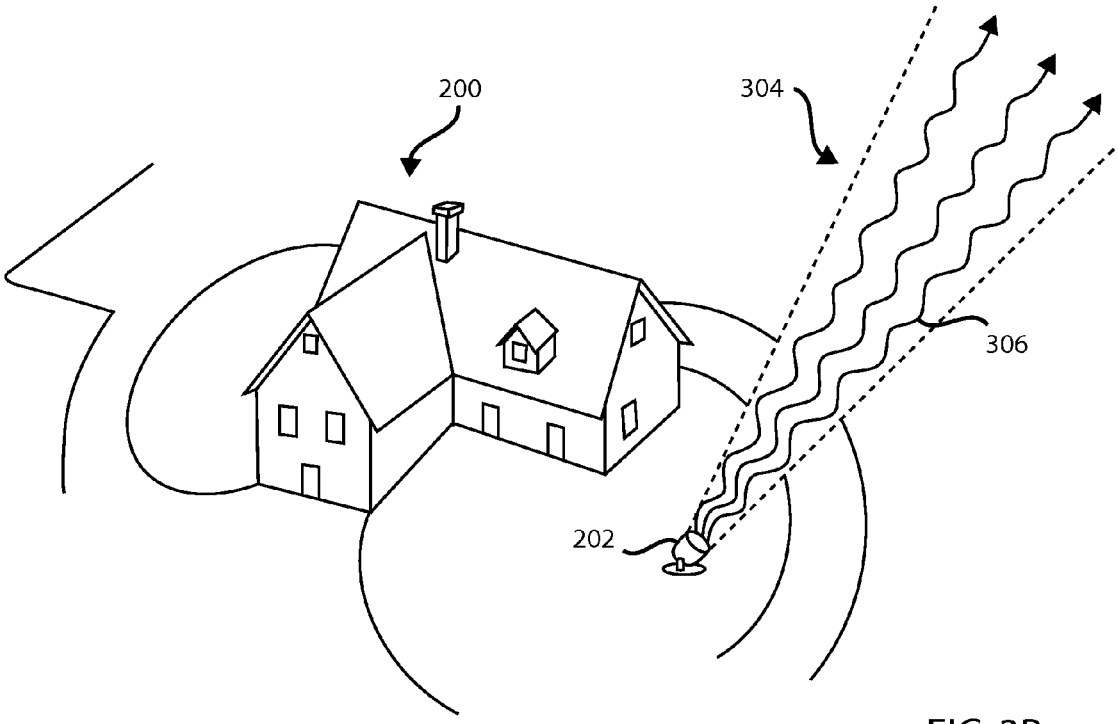
FIG. 3B is an aerial view of a house equipped with an installed version of the embodiment shown in FIG. 3A, showing the light output indicating a larger amount of time elapsed since the intrusion.

FIG. 3B is an aerial view of a house equipped with an installed version of the embodiment shown in FIG. 2A, showing the light output indicating a larger amount of time elapsed since the intrusion. In this figure, the light beam 304 is now less focused and of lesser intensity 306, than it was earlier, as shown in FIG. 3A. This more diffuse and low-intensity light indicates that intrusion into the house 200 has occurred, but it did not occur immediately.

Figure 4:
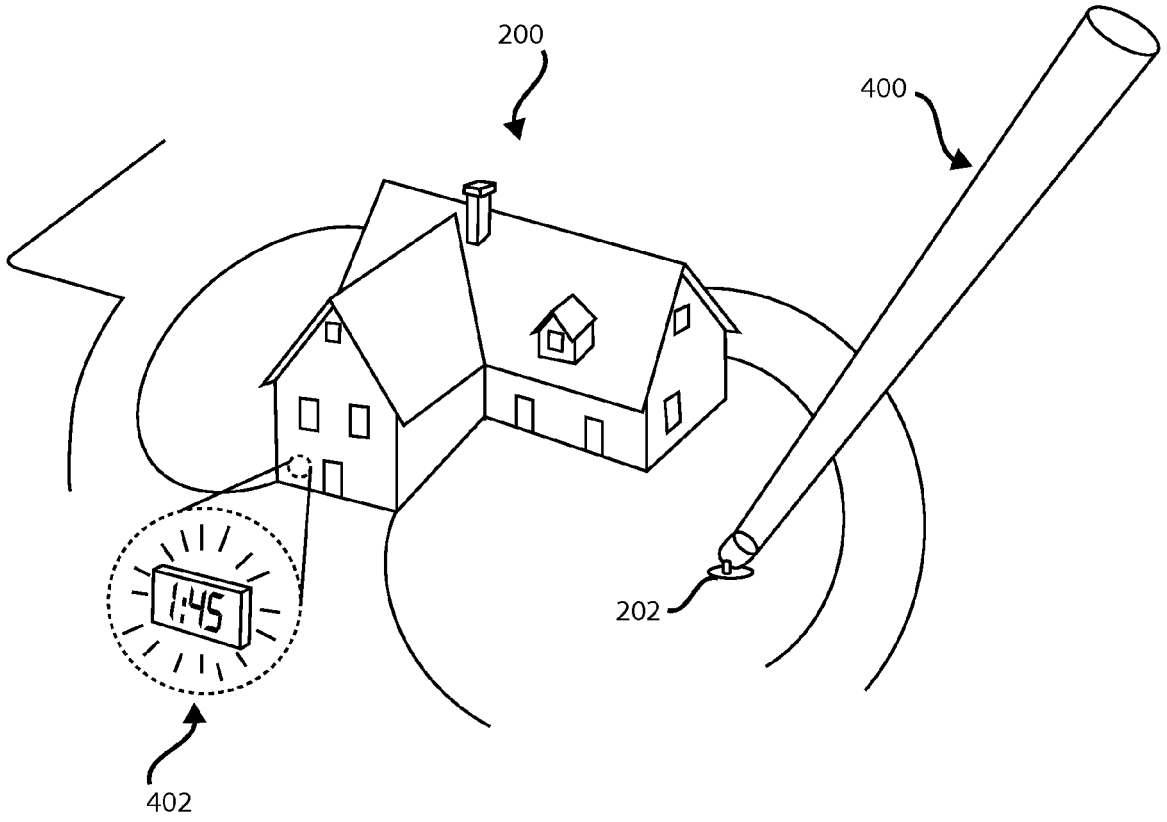
FIG. 4 is an aerial view of a house equipped with an embodiment of a combination of indicator lights of the alarm system.

FIG. 4 is an aerial view of a house equipped with an embodiment of a combination of indicator lights of the alarm system. A house 200 is equipped with an indicator light 202 that emits a continuous light beam 400. In embodiments where the light beam 400 output is non-continuous, the light output can blink at an ever-diminishing frequency, the frequency of the blinks roughly the amount of time that has elapsed since intrusion into the house.

In addition, this embodiment also includes a light display 402 capable of producing a readable output of the time elapsed since the intrusion, wherein the light changing system is configured to change the readable output as time elapses. In the embodiment shown, the light display 402 is located on a wall near a doorway into the house 200. The light display 402 is indicating that intrusion occurred one hour and forty-five minutes ago. In alternative embodiments, the actual time that intrusion had occurred, or some other indication, can be displayed on the light display 402.

Figure 5:
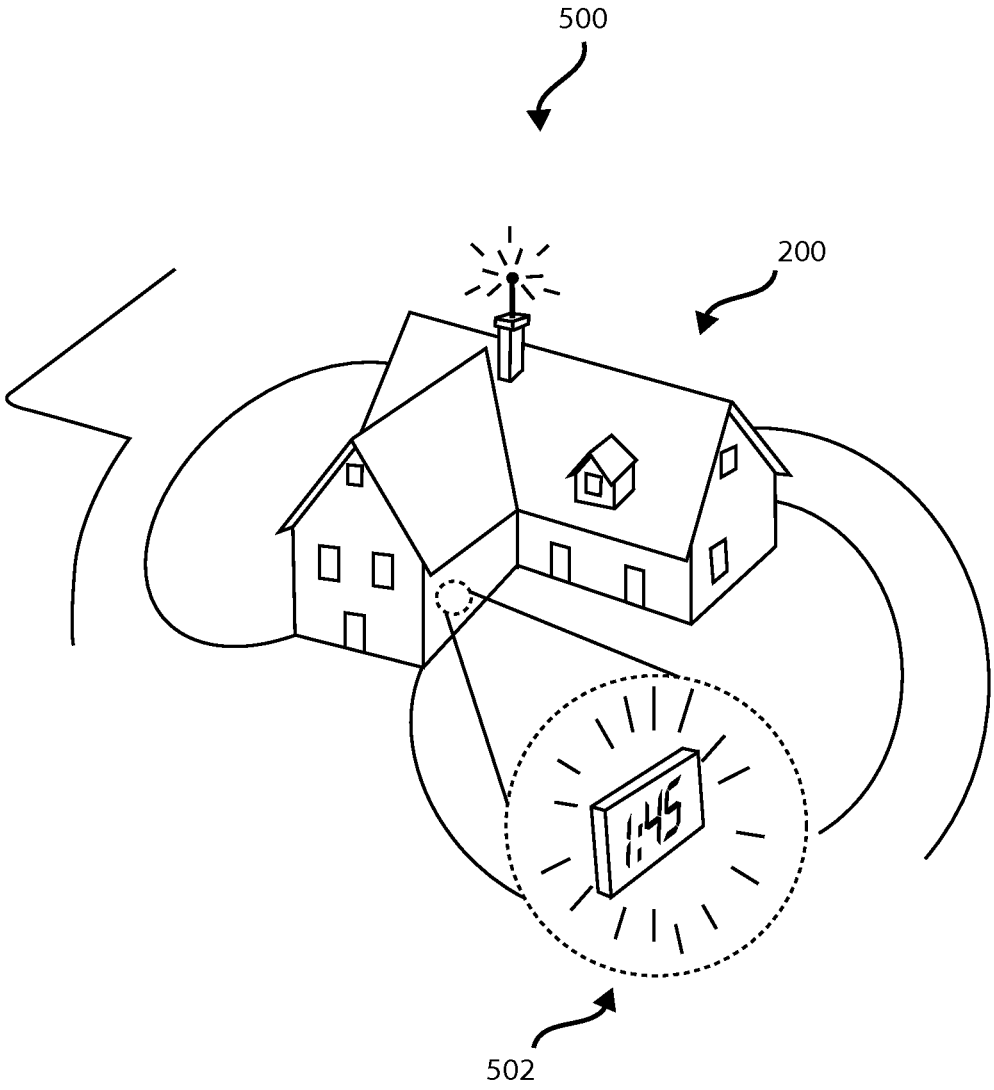
FIG. 5 is an aerial view of a house equipped with an alternative embodiment of a combination of indicator lights of the alarm system.

FIG. 5 is an aerial view of a house equipped with an alternative embodiment of a combination of indicator lights of the alarm system. A house 200 is equipped with an indicator light 500 that emits a beacon light 500, such as light emitted omni-directionally from a bulb, as opposed to a focused beam. The beacon light 500 can be light of continuous output, or alternatively, it can be light of non-continuous output, such as a blinking light. The beacon light 500 is installed at the top of the house 200. In embodiments where the beacon light 500 output is non-continuous, the light output can blink at an ever-diminishing frequency, the frequency of the blinks roughly the amount of time that has elapsed since intrusion into the house.

In addition, this embodiment also includes a light display 502 capable of producing a readable output of the time elapsed since the intrusion, wherein the light changing system is configured to change the readable output as time elapses. In the embodiment shown, the light display 502 is located on a wall around the corner from a doorway into the house 200. The light display 502 is indicating that intrusion occurred one hour and forty-five minutes ago. In alternative embodiments, the actual time that intrusion had occurred, or some other indication, can be displayed on the light display 502.

Figure 6:
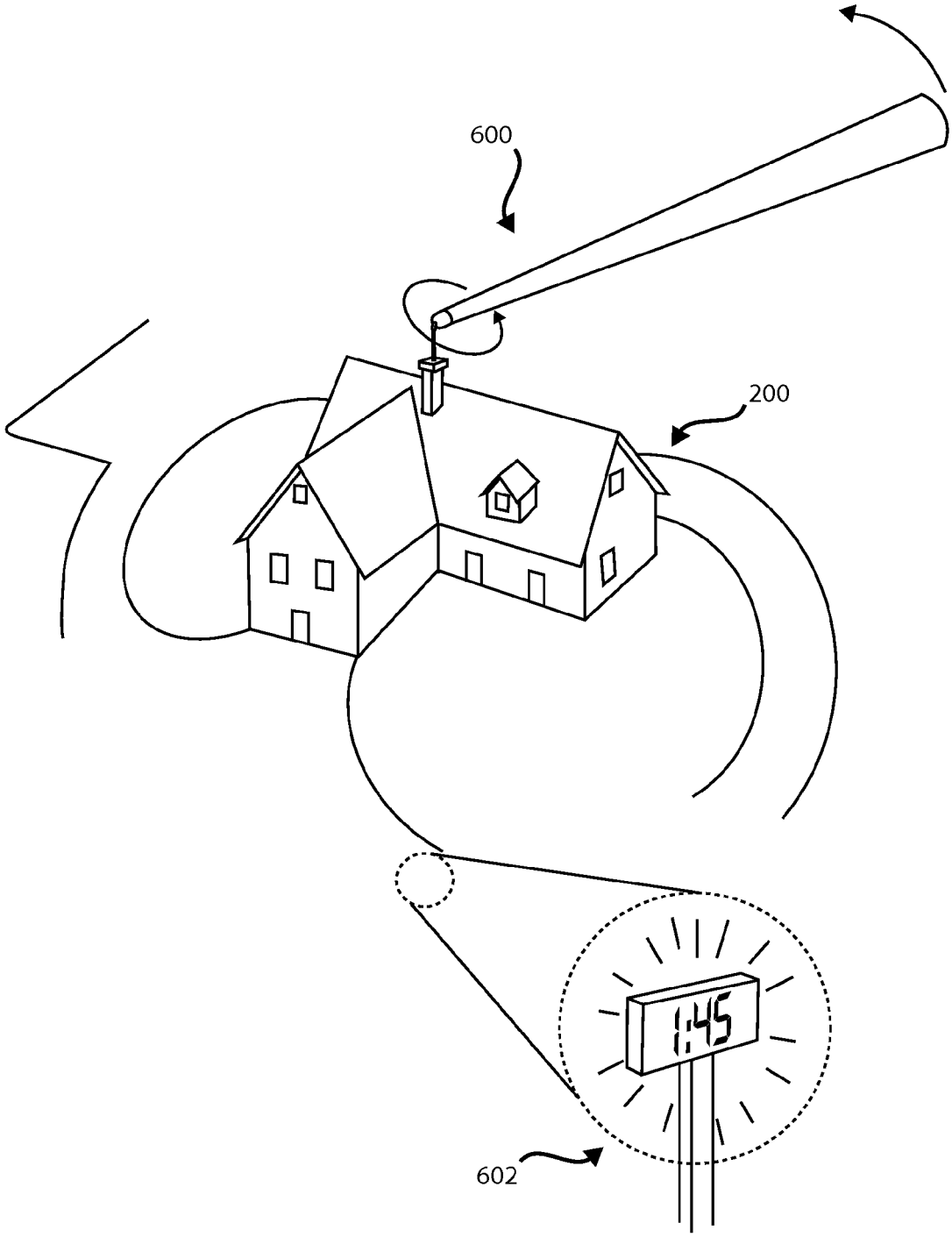
FIG. 6 is an aerial view of a house equipped with another alternative embodiment of a combination of indicator lights of the alarm system.

FIG. 6 is an aerial view of a house equipped with another alternative embodiment of a combination of indicator lights of the alarm system. In this embodiment, the house 200 is equipped with a rotating light beam 600, which is installed at the top of the house 200. The light beam 600 is projected substantially horizontally from a rotating light source. In the embodiment shown, the rotating light beam 600 is a focused light beam which rotates about the vertical axis of its light source. This rotating light 600 can potentially alert others in all directions beyond the curtilage of the house 400, potentially including those located within neighboring dwellings. In embodiments where the rotating light 600 output is non-continuous, the light output can blink at an ever-diminishing frequency, the frequency of the blinks roughly the amount of time that has elapsed since intrusion into the house.

In addition, this embodiment also includes a light display 602 capable of producing a readable output of the time elapsed since the intrusion, wherein the light changing system is configured to change the readable output as time elapses. In the embodiment shown, the light display 602 is located on a walkway towards a doorway of the house 200. The light display 602 is indicating that intrusion occurred one hour and forty-five minutes ago. In alternative embodiments, the actual time that intrusion had occurred, or some other indication, can be displayed on the light display 602.

Figure 7:
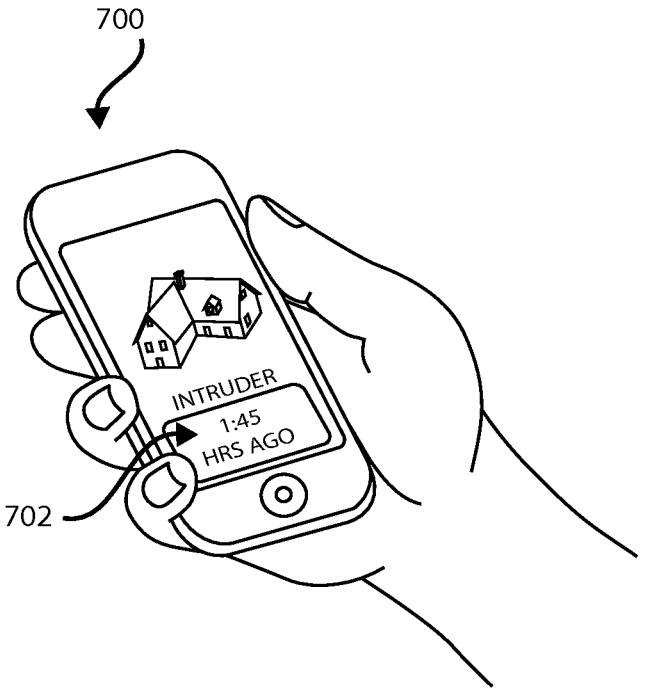
FIG. 7 is an illustration of a component of an embodiment of the alarm system, wherein an elapsed time since intrusion message is produced on a mobile device.

FIG. 7 is an illustration of a component of an embodiment of the alarm system, wherein an elapsed time since intrusion message is produced on a mobile device. In the embodiment shown, a mobile device 700 receives an intrusion time message 702, in addition to an indicator light signal being projected from the outer perimeter zone of the enclosed space with which the indicator light is associated. Such a mobile device intrusion time message 702 can supplement the indicator light, providing an enhancement to the alarm system. For example, if an intrusion is detected, the alarm system can alert those for whom the intruded enclosed space is in sight. In addition, a user of the alarm system can receive an alert 702 on their mobile device 700, which can be an important and useful supplemental alert if and when they are not near or approaching the enclosed space. In the embodiment shown, the intrusion time message 702 indicates that intrusion occurred one hour and forty-five minutes ago. In some embodiments, the intrusion time message 702 can be a one-time message, whereas in other embodiments, the message can be a continuous indicator of elapsed time since intrusion. In still other embodiments, the intrusion time message 702 can simply be a message with a timestamp indicating the time at which intrusion was detected.

Figure 8:
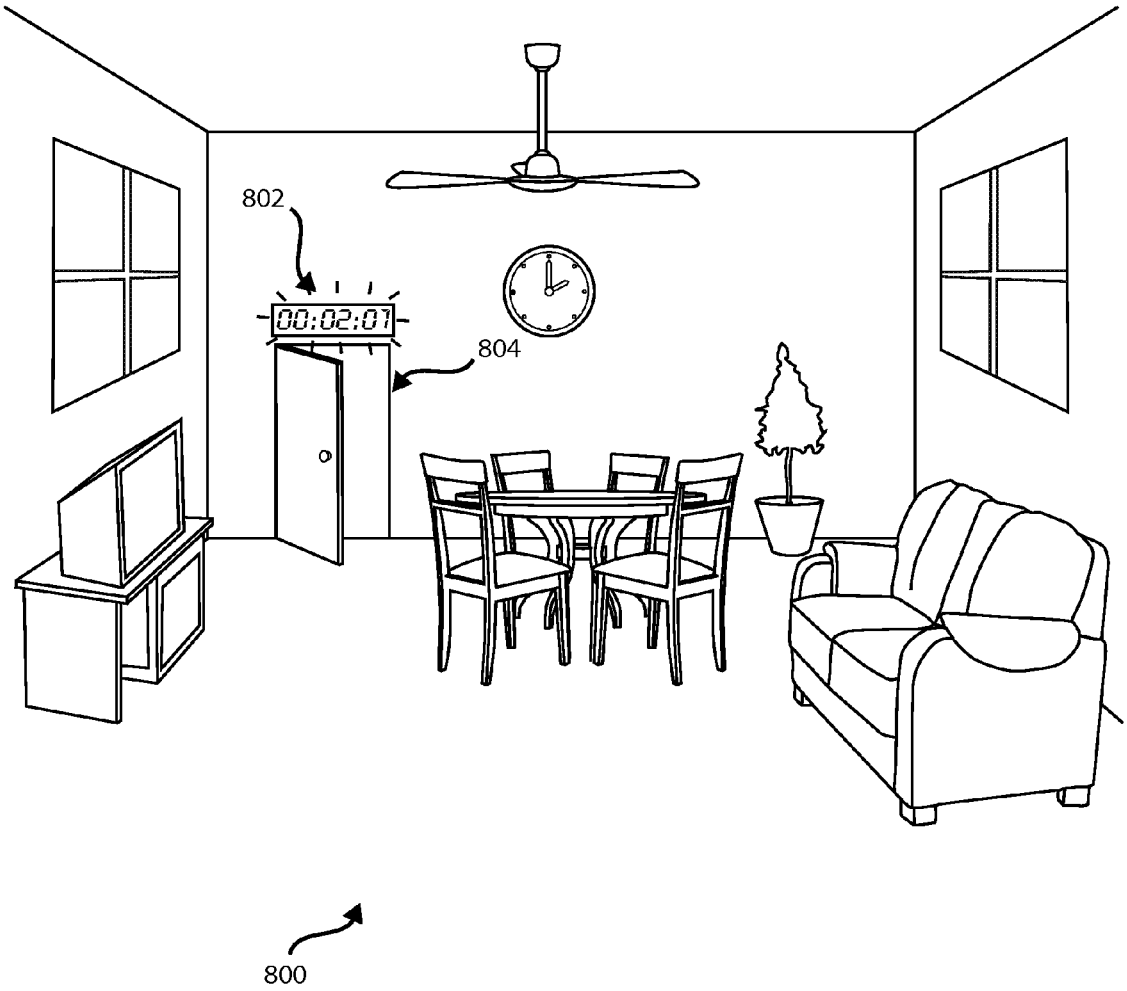
FIG. 8 is an illustration of a room within a building employing an embodiment of the alarm system.

FIG. 8 is an illustration of a room within a building employing an embodiment of the alarm system. In this embodiment, the alarm system is configured to alert others of elapsed time since an intrusion into an enclosed space within a building, in this instance the enclosed space being a room of a house. In this embodiment, a room 800 adjacent to the intruded room is equipped with an indicator light 802. The indicator light in this example is a light display 802 which indicates readable output concerning time elapsed since intrusion.

The light display 802 shown is capable of producing a readable output of the time elapsed since the intrusion, wherein a light changing system is configured to change the readable output as time elapses. In the embodiment shown, the light display 802 is located above a doorway 804 which leads from the adjacent room 800 into the intruded room. The light display 802 is indicating that intrusion occurred two hours and seven minutes ago. In alternative embodiments, the actual time that intrusion had occurred, or some other indication, can be displayed on the light display 802.

The indicator light 802 is located within the outer perimeter zone of the room equipped with the alarm system, and the light display 802 is visible and readable beyond the outer perimeter zone of the room equipped with the alarm system. For example, someone in the adjacent room 800 could easily see the light display and read the output. In some embodiments, several such indicator lights 802 may be placed at various locations within the outer perimeter zone of the enclosed space equipped with the alarm system, so as to alert others in various neighboring rooms, for example.

If an unexpected intrusion occurs in one room, the indicator light 802 can alert others in adjacent rooms 800 of the intrusion, for example. In other embodiments, the enclosed space under surveillance may be a group of rooms, or some other portion of a building, for example. The indicator light 802 is located in the outer perimeter zone immediately outside the enclosed space under surveillance. In this case, the outer perimeter zone includes the doorway 804 and wall of an adjacent room 800. The indicator light 802 is therefore mounted on the adjacent wall of the doorway 804 connecting the intruded room with the adjacent room 800.

Figure 9A:
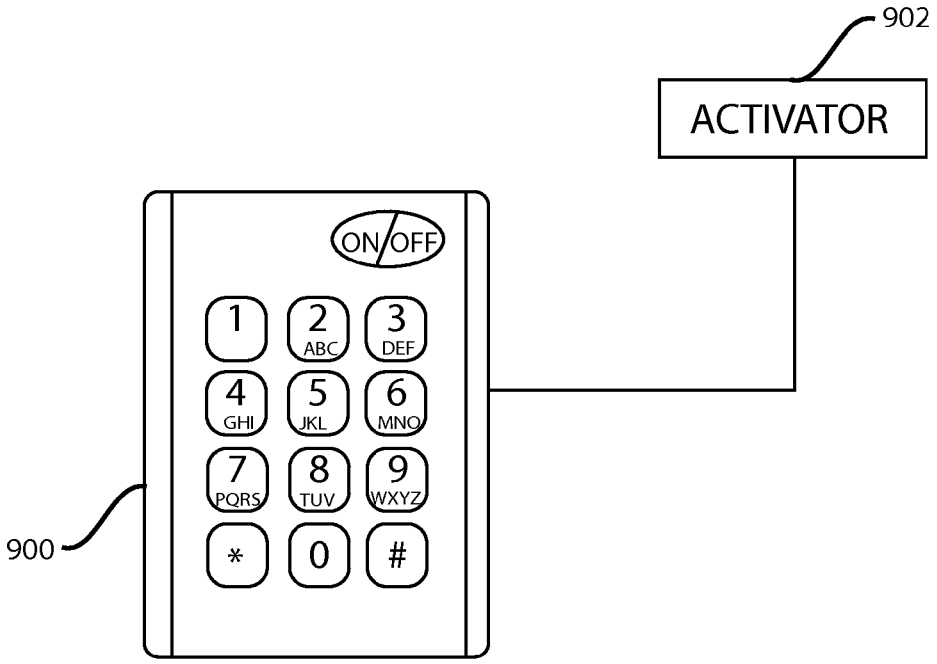
FIG. 9A depicts a keypad configured to control activating system for an embodiment of the alarm system.

The alarm system can be activated through a variety of techniques, some of which are discussed explicitly in this specification, while still others will be readily apparent to one of ordinary skill in the art. FIG. 9A depicts a keypad 900 configured to control an activating system in an embodiment of the alarm system. Such a keypad can be installed on an outer wall of a house, near an entrance into the house for example, or somewhere near the house and within the curtilage of the house, for example. The keypad is connected to and capable of communicating with an activator 902 which can activate the system.

Figure 9B:
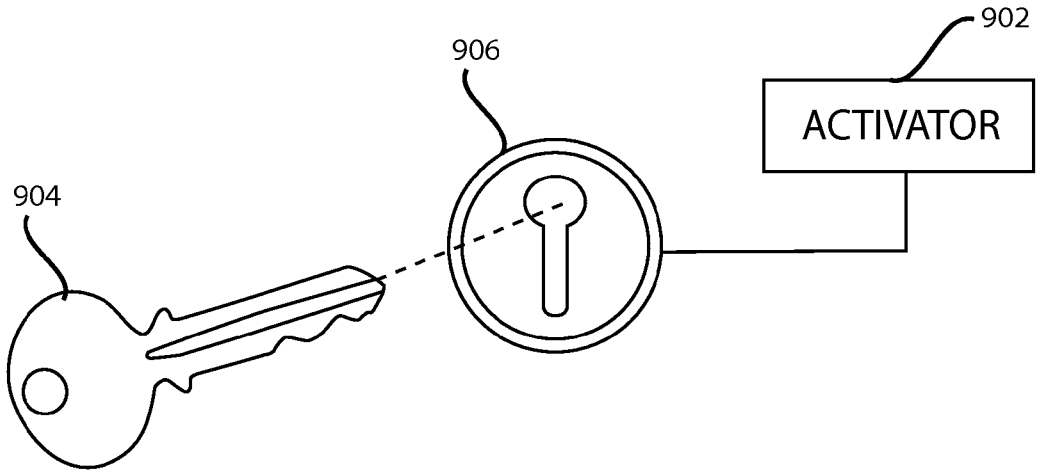
FIG. 9B depicts a manual key and lock configured to control an activating system for an embodiment of the alarm system.

FIG. 9B depicts a manual key and lock configured to control an activating system for an embodiment of the alarm system. In this embodiment, a manual key 904 can fit into a manual keyhole 906, and whereupon the key 904 is inserted into the keyhole 906 and turned, the alarm system can be activated and/or deactivated via communication with an activator 902.

Figure 9C:
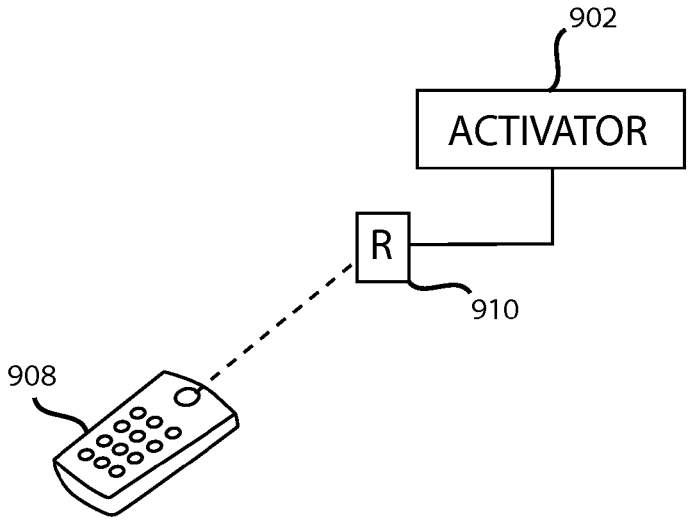
FIG. 9C depicts a remote dedicated device and receiver configured to control an activating system for an embodiment of the alarm system.
Figure 9D:
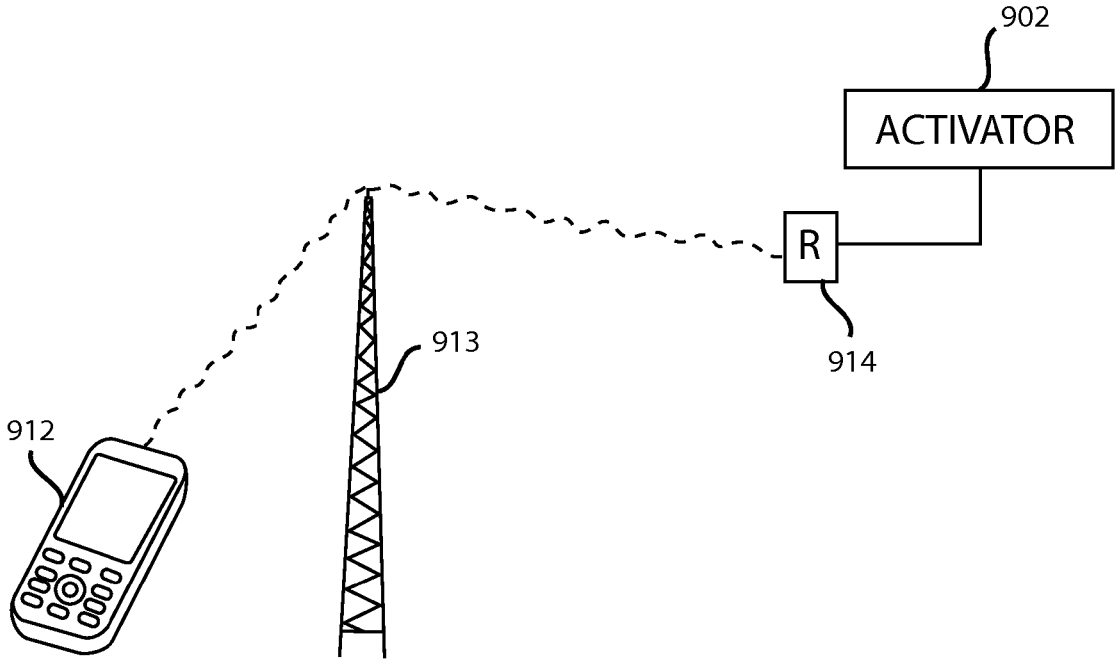
FIG. 9D depicts a personal mobile device and receiver configured to control an activating system for an embodiment of the alarm system.

The alarm system can also be activated via remote devices. FIG. 9C depicts a dedicated remote device 908 and a receiver 910, which in combination are configured to control an activating system in an embodiment of the alarm system. A user of the system can activate the system using a remote control 908 which communicates with a receiver 910, which in turn is linked to an activator 902. FIG. 9D depicts a personal mobile device 912 and reception tower 913 in communication with a receiver 914, which in turn is linked to an activator 902 and configured to control an activating system for an embodiment of the alarm system. Still other activation systems will be readily apparent to one of average skill in the art.

Figure 10:
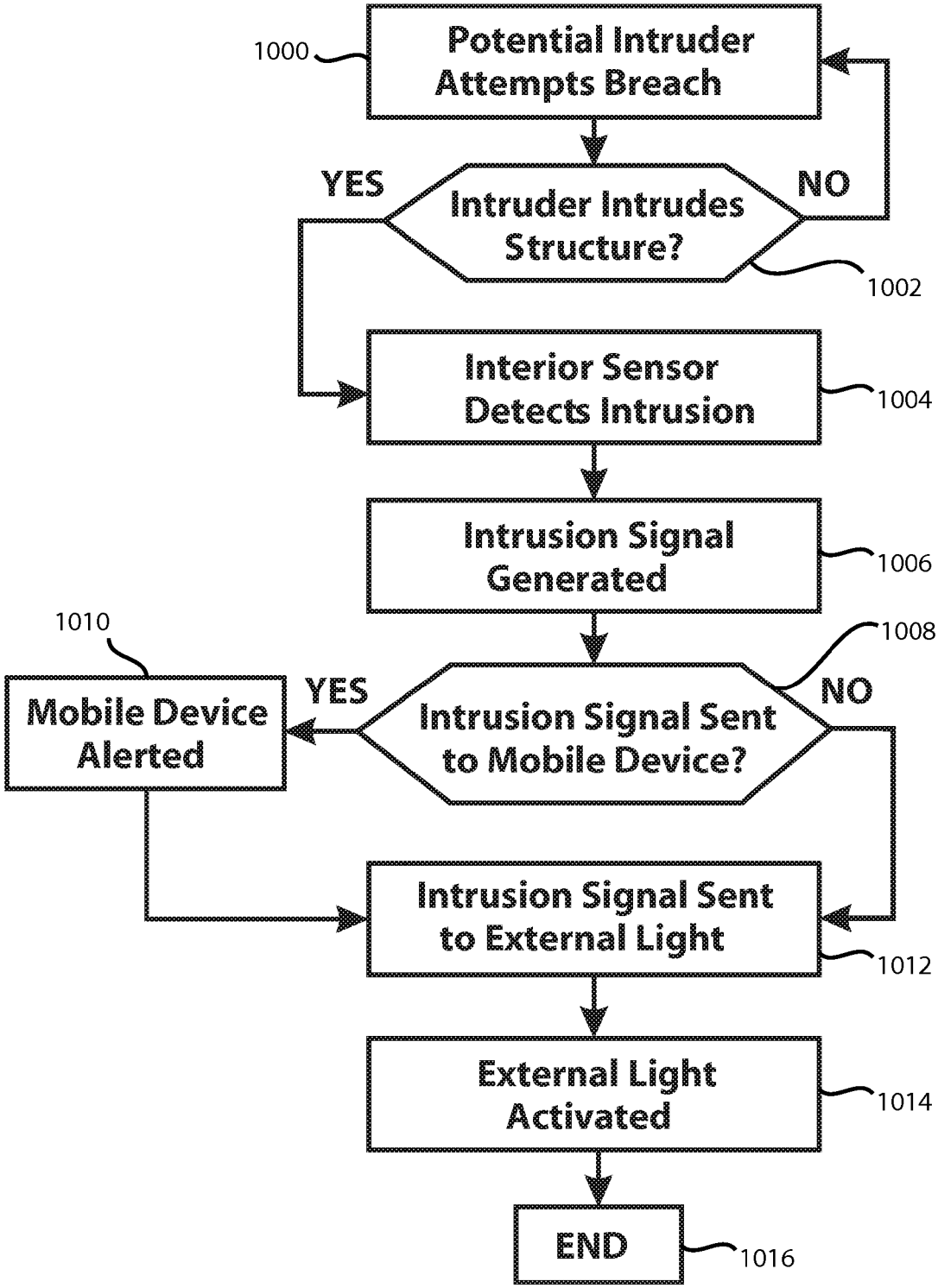
FIG. 10 is a flowchart depicting a sequence of events related to an embodiment of the alarm system in use.

FIG. 10 is a flowchart depicting a sequence of events related to an embodiment of the alarm system in use, in relation to a structure. First, a potential intruder attempts to breach and/or intrude a structure or other enclosed space equipped with the system 1000, with intent to intrude the structure or enclosed space. In this embodiment, the entire structure is equipped with the system, while in alternative embodiments only a sub-enclosure, such as a room within the structure, might be so equipped.

If the intruder succeeds in intruding the structure 10002, an interior sensor will detect the intrusion 1004 and generate an intrusion signal 1006, which in the present invention is an intrusion time signal indicating elapsed time since intrusion. If the system includes for the intrusion time signal to be sent to a user's mobile device 1008, then the mobile device can be alerted 1010. The intrusion time signal is sent to an indicator light 1012, which then activates and outputs an alarm light 1014 upon receiving the information regarding the intrusion time signal. The indicator light indicates the time elapsed since intrusion has occurred. This completes the main operation of the system 1016.

Other modifications and implementations will occur to those skilled in the art without departing from the spirit and the scope of the invention as claimed. Accordingly, the above description is not intended to limit the invention except as indicated in the following claims.

The invention claimed is:

1. An alarm system for providing an indication of time elapsed since an intrusion into an enclosed space, the enclosed space being surrounded by an outer perimeter zone, the indication enabling an observer situated outside the outer perimeter zone to learn at least approximately how much time has elapsed since the intrusion, the alarm system comprising:

at least one interior sensor being located within an enclosed space, the at least one sensor configured to generate an intrusion time signal in response to an intrusion into the enclosed space;

an indicator light responsive to the intrusion time signal, the indicator light being located outside the enclosed space and within an outer perimeter zone of the enclosed space, the indicator light being configured to emit light upon receiving the intrusion time signal, the emitted light being visible from outside the outer perimeter zone of the enclosed space, thereby rendering the enclosed space readily identified as having been intruded upon by an observer situated outside a perimeter zone of the enclosed space; and a light changing system responsive to the intrusion time signal, and in communication with the indicator light, the light changing system being configured to change the emitted light over time so as to indicate at least approximately how much time has elapsed since the intrusion.

2. The alarm system of claim 1, wherein the emitted light is changed by changing at least one of:

wavelength of the emitted light;

intensity of the emitted light;

focus of the emitted light, wherein the emitted light is a light beam;

frequency of blinking of the emitted light, wherein the emitted light is a blinking light;

alphanumeric pattern of the emitted light, wherein the emitted light is produced by an alphanumeric display.

3. The alarm system of claim 1, wherein the indicator light is a light display that is capable of producing a readable output of the time elapsed since the intrusion, and wherein the light changing system is configured to change the readable output as time elapses.

4. The alarm system of claim 1, wherein at least one the interior sensor is capable of detecting intrusion into the structure in proximity to at least one of:

a peripheral window of the enclosed space;

a peripheral door of the enclosed space;

a chimney of the enclosed space; and a general internal area of the enclosed space.

5. The alarm system of claim 1, wherein the indicator light is at least one of:

a focused light beam;

a beacon light;
a blinking light; and
a rotating light.

6. The alarm system of claim 1, wherein the intrusion time signal is sent directly from the at least one interior sensor to the indicator light, thereby initiating activation of the indicator light.

7. The alarm system of claim 1, wherein the light changing system is configured to receive the intrusion time signal from the at least one intrusion detector, and to send an activation signal to the indicator light, thereby initiating activation of the indicator light.

8. The alarm system of claim 1, wherein the intrusion time signal is sent from the at least one interior sensor to the indicator light via one of:
electrical wiring; and
wireless signaling.

9. The alarm system of claim 1, wherein the intrusion time signal is also received on a mobile device.

10. The alarm system of claim 1, wherein the system can be activated by at least one of:
a keypad installed near an entrance of the enclosed space;
a keypad installed within the outer perimeter zone of the enclosed space;
a manual key configured to fit a manual lock;
a remote control device dedicated to activation of the system; and
a personal mobile communication device.

11. A method of installing an alarm system for providing an indication of time elapsed since an intrusion into an enclosed space, the enclosed space being surrounded by an outer perimeter zone, the indication enabling an observer situated outside the outer perimeter zone to learn at least approximately how much time has elapsed since the intrusion, the alarm system comprising:
mounting at least one interior sensor located within an enclosed space, the at least one sensor being configured to generate an intrusion time signal in response to an intrusion into the enclosed space;
mounting an indicator light responsive to the intrusion time signal, the indicator light being located outside the enclosed space and within an outer perimeter zone of the enclosed space,
the indicator light being configured to emit light upon receiving the intrusion time signal, the emitted light being visible from outside the outer perimeter zone of the enclosed space, thereby rendering the enclosed space readily identified as having been intruded upon by an observer situated outside a perimeter zone of the enclosed space; and
installing a light changing system responsive to the intrusion time signal, and in communication with the indicator light, the light changing system being configured to change the emitted light over time so as to indicate at least approximately how much time has elapsed since the intrusion.

12. The method of claim 11, wherein the emitted light is changed by changing at least one of:
wavelength of the emitted light;
intensity of the emitted light;
focus of the emitted light, wherein the emitted light is a light beam;
frequency of blinking of the emitted light, wherein the emitted light is a blinking light;
alphanumeric pattern of the emitted light, wherein the emitted light is produced by an alphanumeric display.

13. The method of claim 11, wherein the indicator light is a light display that is capable of producing a readable output of the time elapsed since the intrusion, and wherein the light changing system is configured to change the readable output as time elapses.

14. The method of claim 11, wherein at least one the interior sensor is capable of detecting intrusion into the structure in proximity to at least one of:
a peripheral window of the enclosed space;
a peripheral door of the enclosed space;
a chimney of the enclosed space; and
a general internal area of the enclosed space.

15. The method of claim 11, wherein the indicator light is at least one of:
a focused light beam;
a beacon light;
a blinking light; and
a rotating light.

16. The method of claim 11, wherein the intrusion time signal is sent directly from the at least one interior sensor to the indicator light, thereby initiating activation of the indicator light.

17. The method of claim 11, wherein the light changing system is configured to receive the intrusion time signal from the at least one intrusion detector, and to send an activation signal to the indicator light, thereby initiating activation of the indicator light.

18. The method of claim 11, wherein the intrusion time signal is sent from the at least one interior sensor to the indicator light via one of:
electrical wiring; and
wireless signaling.

19. The method of claim 11, wherein the intrusion time signal is also received on a mobile device.

20. The method of claim 11, wherein the system can be activated by at least one of:
a keypad installed near an entrance of the enclosed space;
a keypad installed within the outer perimeter zone of the enclosed space;
a manual key configured to fit a manual lock;
a remote control device dedicated to activation of the system; and
a personal mobile communication device.

* * * * *